United States Patent [19]

Brokaw

[11] 4,250,445

[45] Feb. 10, 1981

[54] BAND-GAP VOLTAGE REFERENCE WITH CURVATURE CORRECTION

[75] Inventor: Adrian P. Brokaw, Burlington, Mass.

[73] Assignee: Analog Devices, Incorporated, Norwood, Mass.

[21] Appl. No.: 4,014

[22] Filed: Jan. 17, 1979

[51] Int. Cl.[3] ..... G05F 1/58

[52] U.S. Cl. ..... 323/313; 323/907

[58] Field of Search ..... 323/1, 4, 16, 19, 22 T, 323/23, 25; 307/296, 297

[56] References Cited

U.S. PATENT DOCUMENTS

| | | | |
|---|---|---|---|
| 3,976,896 | 8/1976 | Ryder | 307/297 |
| 4,087,758 | 5/1978 | Hareyama | 323/23 X |

*Primary Examiner*—William H. Beha, Jr.

*Attorney, Agent, or Firm*—Parmelee, Johnson, Bollinger & Bramblett

[57] ABSTRACT

A temperature-compensated band-gap reference of the type employing two transistors operated at different current densities to develop a positive TC current. This current flows through a first resistor of nominal TC to develop a positive TC voltage which is connected in series with a negative TC voltage developed by the base-to-emitter voltage of a transistor, to produce a composite temperature compensated output voltage. The circuitry further includes a second resistor connected in series with the first resistor and having a positive TC to produce an additional compensating voltage having a temperature coefficient following a parabolic expression. This additional voltage, when connected with the other components of the output voltage, reduces the small residual inherent TC of the band-gap reference to provide a more stable reference source.

5 Claims, 1 Drawing Figure

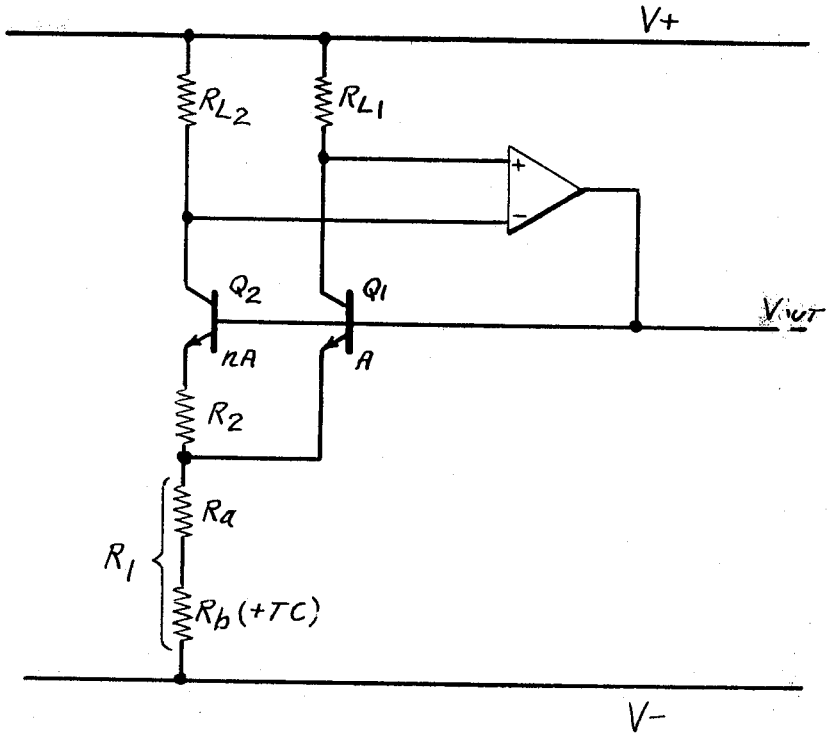
V+
$R_{L2}$
$R_{L1}$
+
−
$Q_2$
$Q_1$
$V_{OUT}$
nA
A
$R_2$
$R_a$
$R_1$
$R_b$ (+TC)
V−

BAND-GAP VOLTAGE REFERENCE WITH CURVATURE CORRECTION

BACKGROUND OF THE INVENTION

This invention relates to solid-state (IC) band-gap voltage references for providing an output voltage which is substantially constant with changes in temperature. More particularly, this invention relates to band-gap references provided with temperature compensation means to minimize changes in output voltage with changes in temperature.

Solid-state IC references have been developed which rely on certain temperature-dependent characteristics of the base-to-emitter voltage ($V_{BE}$) of a transistor. For example, in U.S. Pat. No. 3,617,859, an IC reference is described in which a diode-connected transistor and a second transistor are operated at different current densities to develop a voltage across a resistor proportional to the difference in the respective base-to-emitter voltages ($\Delta V_{BE}$). This difference voltage has a positive temperature coefficient (TC), and is connected in series with the $V_{BE}$ voltage of a third transistor. The latter voltage has a negative TC which counteracts the positive TC of the first voltage to produce a composite voltage with a relatively low TC and serving as the output of the reference.

In U.S. Pat. No. 3,887,863, issued to the present applicant, a three-terminal band-gap reference is disclosed using a band-gap cell requiring only two transistors. These transistors are connected in a common base configuration, and the ratio of current densities in the two transistors is automatically maintained at a desired value by an operational amplifier which senses the collector currents of the two transistors. A voltage responsive to the $\Delta V_{BE}$ of the two transistors is developed across a resistor, and that voltage is connected in series with the $V_{BE}$ voltage of one of the two transistors, resulting in a combined output voltage with a very low temperature coefficient.

The mathematical relationships regarding the variation of voltage with temperature in band-gap devices commonly are simplified for purposes of analysis by ignoring certain terms of the basic equation, as expressing only secondary non-significant effects. For example, in the above U.S. Pat. No. 3,617,859, column 4, line 6, it is explained that the last two terms of the given expression are deleted because they are considered to be insignificant. However, although the effects of such secondary terms are small, they are real, and can be important in some applications. Thus, it is desired to provide a way to avoid variations in output voltage corresponding to such secondary and presently uncompensated effects.

The mathematical analysis of the problem when retaining the commonly-ignored terms is somewhat involved, as can be seen in the article by the present applicant published in the IEE Journal of Solid-State Circuits, Vol. SC-9, No. 6, December 1974, and entitled "A Simple Three-Terminal IC Band-gap Reference". Proper expressions can, nevertheless, be developed for the output voltage, and the first and second derivatives thereof with respect to temperature, as shown in the following Equations 12–14 from that article:

$$E = V_{go} + (T/T_o)(V_{BEo} - V_{go}) + (m-1)(kT/q)\ln(T_o/T) + (P_1+1)(R_1/R_2)(kT/q)\mathrm{LN}(J_1/J_2) \quad (12)$$

$$dE/dT = (1/T_o)(V_{BEo} - V_{go}) + (P_1+1)(R_1/R_2)(k/q)\ln(J_1/J_2) + (m-1)(k/q)\ln(T_o/T) - 1 \quad (13)$$

$$d^2E/dT^2 = -(m-1)(k/q)(1/T). \quad (14)$$

With values of m greater than one (a realistic assumption), equation (14) implies a non-zero temperature coefficient at temperatures other than $T_o$. However, it will be evident from the above considerations that the output voltage varies with temperature in such a way that an exact compensation for such variation would require quite complex circuitry, too costly for most applications.

Accordingly, it is an object of the present invention to provide a band-gap reference with improved compensation for its inherent temperature characteristic.

SUMMARY OF THE INVENTION

It has been noted that the final output voltage vs. temperature characteristic, including the secondary effects referred to above, is roughly parabolic in form about the nominal temperature $T_o$. It has further been found that a very good compensation for the second order effects can be achieved by a very simple change in the basic circuitry. More specifically, it has been found that the problem can substantially be solved by incorporating in the band-gap cell, in series with the already-provided resistor which receives the PTAT current (i.e. the current developed in accordance with the $\Delta V_{BE}$ of the two transistors), an additional resistor having a more positive temperature coefficient than the first resistor (which ordinarily has a nearly zero TC). The positive TC of this additional resistor, together with the PTAT current flowing therethrough, produces a voltage the expression for which includes a parabolic term. The circuit elements can be so arranged that the additional voltage component resulting from this parabolic term substantially counteracts the second order variations of the voltage produced by the basic band-gap circuit described above.

In carrying out this invention, in one illustrative embodiment thereof, a first voltage is developed across a first resistor by passing a current proportional to temperature through the first resistor. A second voltage is developed across a second resistor, having a more positive temperature coefficient than the first resistor, by passing a current proportional to temperature therethrough. These first and second voltages are coupled additively to the $V_{BE}$ voltage of a transistor, to introduce the negative TC of the emitter-to-base voltage of that transistor into the resulting composite voltage. The final output voltage provides good compensation for the second order effects, referred to above, which are not corrected by the basic band-gap compensation feature.

BRIEF DESCRIPTION OF THE DRAWING

The single drawing of this application is a circuit diagram showing a band-gap cell of the type described in the above-mentioned U.S. Pat. No. 3,887,863, modified to incorporate further temperature-compensating means in accordance with this invention.

DESCRIPTION OF A PREFERRED EMBODIMENT

The principles of the present invention will be explained by describing the invention applied to the type of band-gap cell disclosed in U.S. Pat. No. 3,887,863. However, it should be understood that the invention is capable of being used with other types of band-gap references, such as that shown in U.S. Pat. No. 3,617,859.

The single drawing figure of the present application is identical to FIG. 1 of the above-referenced '863 patent except that the resistor $R_1$ of that patent has in the new circuit been arranged as two separate resistors $R_a$ and $R_b$ having characteristics to be explained in more detail subsequently. As described in the '863 patent, the current flowing through $R_1$ is PTAT, i.e. it is proportional to the $\Delta V_{BE}$ of transistors $Q_1$ and $Q_2$, thereby developing across $R_1$ a voltage having a positive TC. This voltage is connected in series with the $V_{BE}$ of transistor $Q_1$, having an inherent negative TC. The output voltage $V_{out}$ at the base of $Q_1$ thus comprises positive and negative TC components which tend to counteract to minimize changes in voltage with temperature.

The circuit arrangement employing $R_1$ as shown in the above-noted '863 patent nearly eliminates any variation in output voltage with changes in temperature. There remains, however, small changes in output voltage due to secondary effects which normally are ignored in conventional analysis of the circuitry. These small changes conform to an approximately parabolic function about the nominal operating temperature of the circuit. It has been found that these secondary effects can effectively be compensated for by using for $R_1$ a pair of series-connected resistors $R_a$ and $R_b$, wherein $R_b$ has a large positive TC, and $R_a$ has the same TC as the original resistors $R_1$ and $R_2$ (e.g., zero). The voltage across a positive TC resistor ($R_b$) which is driven with a PTAT current will contain a parabolic term, and the voltage component corresponding to this term can be sized to compensate for the inherent parabolic variation of the band-gap cell voltage described above, to result in a more nearly perfect zero TC reference source.

To explain these considerations in more detail, where $R_1$ is composed of two resistor segments $R_a$ and $R_b$, and $R_a$ has the same TC as $R_2$, but $R_b$ has a large positive TC, then the following equations can be made to apply:

$$R_b = \frac{(m-1)R_2}{2\ln A\left(2T\left(\frac{1}{R_b}\frac{dR_b}{dT} - \frac{1}{R_2}\frac{dR_2}{dT}\right) + T^2\left(\frac{1}{R_b}\frac{d^2R_b}{dT^2} - \frac{1}{R_2}\frac{d^2R_2}{dT^2}\right)\right)} \quad (1)$$

where A is the area (or current density) ratio of the two transistors and m and T have the usual meaning.

Including $R_b$ in the circuit changes the optimum output voltage, $V_o$, to result in zero TC at $T_o$, implying:

$$V_o = V_{GO} + \frac{KT}{q}(m-1)\left(1 - \frac{1}{2 + \frac{\left[\frac{T^2}{R_b}\frac{d^2R_b}{dT^2} - \frac{T^2}{R_2}\frac{d^2R_2}{dT_2}\right]}{\left[\frac{T}{R_b}\frac{dR_b}{dT} - \frac{T}{R_2}\frac{dR_2}{dT}\right]}}\right) \quad (2)$$

Neglecting the TC of $R_2$, and with $R_b$ PTAT (for example, an aluminum resistor) then equation (1) reduces to:

$$R_b = \frac{(m-1)R_2}{4\ln A} \quad (3)$$

and equation (2) becomes:

$$V_o = V_{GO} + \frac{KT(m-1)}{q^2} \quad (4)$$

An aluminum resistance may be too large for most practical applications. If a diffused resistor is used, its resistance vs. temperature function is of the form:

$$R_b = R_0(1 + Xt + Yt^2) \quad (5)$$

where t is the temperature with respect to 25° C. As a result of defining the function around 25° C., the relative derivatives can be evaluated at this temperature. That is:

$$(1/R_b)(dR_b/dT = X \quad (6)$$

and:

$$(1/R_b)(d^2R_b/dT^2) = 2Y \quad (7)$$

It has been found that for certain standard commercial processes X is about $1.65\times10^{-3}$ and Y is about 5.36 a $10^{-6}$. Data on thin film resistor material gives an X value more than 30 times smaller.

Since the correction is a second order approximation at best, the TC's of thin film resistors can be ignored, so as to reduce equation (1) and (2) as follows:

$$R_b = \frac{(m-1)R_2}{2\ln A\,(1.935379)} \quad (8)$$

and:

$$V_0 = V_{GO} + (KT/q)(m-1)(0.602623) \quad (9)$$

Using m=1.8, A=6.76, $R_2$=500Ω, and T=298°
$R_b$=54Ω
$V_0$=1.2174 volts

By giving the resistor $R_b$ a first order positive TC, a second order compensation can be developed, because the current flowing through $R_b$ has a first order positive TC. Similarly, when appropriate to a given requirement, a third order compensation can be effected by using a resistor having a second order TC.

The preferred embodiment described uses a resistor $R_1$, comprising two series-connected resistors $R_a$ and $R_b$, where $R_a$ has the same TC as the resistor $R_2$, and the resistor $R_b$ has a significantly more positive TC than $R_a$ and $R_2$. Still other configurations can be used, it being important primarily that the output voltage have a correction component developed by passing a positive TC current through a resistor having a TC which is more positive than that of the other voltage developing resistors in the circuit. Such a construction gives rise to higher order temperature correction, thus providing a more accurate voltage reference.

Accordingly, although a specific preferred embodiment of the invention has been described hereinabove in detail, it is desired to stress that this is for the purpose of illustrating the invention, and is not to be considered as necessarily limitative thereof, because it is apparent that various modifications within the scope of the invention can be made by those skilled in this art to meet the requirements of specific applications.

I claim:

1. In a solid-state regulated voltage supply of the type including first and second transistors operated at different current densities and connected with associated circuitry to develop a current with a positive TC proportional to the difference in the respective base-to-emitter voltages of said transistors, said current passing through at least one resistor to develop a corresponding voltage with a positive TC, the voltage supply including means combining said positive TC voltage with a negative TC voltage, derived from the base-to-emitter voltage of a transistor, to provide a composite temperature-compensated output voltage; that improvement comprising:

additional resistor means in said associated circuitry and connected in series with said one resistor to produce an additional voltage to be combined with said negative TC voltage to produce said composite output voltage;

said additional resistor means having a temperature coefficient that is more positive than that of said one resistor.

2. A voltage supply as in claim 1, wherein said additional resistor means has a large positive TC.

3. A voltage supply as in claim 1, wherein said additional resistor means has a positive TC with both first and second order components.

4. In a solid-state regulated voltage supply of the type including first and second transistors, first resistance means connected between the emitter of said first transistor and a reference line, second resistance means connected between the emitters of said transistors, and control means for providing a predetermined nonunity ratio of current densities for the currents passing through the emitters of said two transistors, whereby the current flowing through said resistance means has a positive temperature coefficient and produces a corresponding voltage across said first resistance means in series with the base-to-emitter voltage of said first transistor; that improvement wherein;

said first resistance means has a net TC which is more positive than the TC of said second resistance means.

5. A voltage supply as in claim 4, wherein said first resistance means comprises first and second resistors with one having a TC which is substantially the same as the TC of said second resistance means, and the other having a TC more positive than that of said one resistor.

* * * * *